US005272415A

United States Patent [19]

Griswold et al.

[11] Patent Number: 5,272,415

[45] Date of Patent: Dec. 21, 1993

[54] COMBUSTION IGNITOR

[75] Inventors: James E. Griswold; Ronald P. Corio; Ronald C. Pate, all of Albuquerque, N. Mex.

[73] Assignee: Hensley Plasma Plug Partnership, Albuquerque, N. Mex.

[21] Appl. No.: 414,054

[22] Filed: Sep. 28, 1989

[51] Int. Cl.[5] ..... H01T 13/04

[52] U.S. Cl. ..... 315/58; 123/143 B; 123/596; 123/605

[58] Field of Search ..... 315/58; 123/143 A, 143 B, 123/143 C, 596, 605

[56] References Cited

U.S. PATENT DOCUMENTS 3,683,232 8/1972 Baur ..... 315/58
4,589,398 5/1986 Pate et al. ..... 123/596
4,767,967 8/1988 Tanaka et al. ..... 315/209 R

FOREIGN PATENT DOCUMENTS 2908051 12/1979 Fed. Rep. of Germany ..... 315/58

*Primary Examiner*—Eugene R. LaRoche
*Assistant Examiner*—Son Dinh
*Attorney, Agent, or Firm*—Dykema Gossett

[57] ABSTRACT

An ignitor (10) for initiation combustion of fuel in an internal combustion engine includes a body portion (12) and a removable electrode portion (14) to permit replacement or repair of the electrodes, so that current is delivered to one of the electrodes (72) along a path through each of the capacitive elements. The body portion includes a pair of capacitive elements defined by longitudinally spaced, radially extending, annular capacitor plates (60, 62, 64, 66) which surround the central electrode (26, 72). The body portion includes an outer, cylindrical shell (16) which is insulated from the capacitive elements by layers (40, 42) of high dielectric material.

40 Claims, 3 Drawing Sheets

COMBUSTION IGNITOR

TECHNICAL FIELD

The present invention generally relates to electrically responsive devices for initiating combustion of fuel, and deals more particularly with an ignitor device of the type having electrical capacitance for transferring stored electrical energy to a pair of ignitor discharge electrodes.

BACKGROUND ART

Various types of ignitor devices have been devised in the past for the purpose of initiating combustion of fuel. Others have recognized the importance of transferring a large amount of energy from an energy source to a fuel air mixture in order to ignite the mixture and thus have resorted to incorporating capacitive elements in the ignitor for this purpose. Ignitor devices of the type described above may be more accurately characterized as conventional spark plugs which are concerned with producing a "hotter" spark. The peak power delivered to the electrical discharge of such devices is relatively low.

More recently, systems have been devised for increasing the efficiency with which electrical discharge energy is coupled to the fuel in order to initiate and promote a more rapid combustion event and extend the lean operating limit of the fuel mixture. For example, U.S. patent application Ser. No. 701,482, filed Feb. 14, 1985, discloses a system for initiating combustion of fuel, especially for internal combustion engines, which employs a very rapid, intense high power electrical breakdown to increase the rate of combustion and thereby reduce the need for advanced engine timing. The use of a driving circuit which has exceptionally low inductance and resistance results in the rapid electrical breakdown and coupling of at least 50 percent of the stored pulse energy to the breakdown channel within the first half period of the discharge current cycle. The resulting discharge effects enhance combustion of the fuel through, among other things, the cooperative effects of photolysis, supersonic hydrodynamic shock waves and high temperature thermal plasma. The ignitor device employed in the above-referenced system must possess extremely low inductance and resistance and may include means for storing a substantial amount of energy in close proximity to the electrodes of the device so as to quickly transfer this stored energy to the breakdown channel. The combustion ignitor of the present invention meets these requirements and is intended to be employed with such a system, although it is contemplated that the present invention could be used advantageously with other systems as well.

SUMMARY OF THE INVENTION

According to the present invention, a combustion ignitor is provided for use with a combustion initiation system typically employed in connection with an internal combustion engine for initiating combustion of a fuel air mixture. The ignitor is characterized by exceptionally low inductance and resistance and is provided with capacitive means for storing a substantial amount of energy in close proximity to a pair of ignitor electrodes between which the stored electrical energy is discharged. The ignitor broadly comprises a generally cylindrical body portion adapted to be coupled with a coaxial electrical power supply cable and an electrode portion which may be stationarily or removably secured on the body portion, thereby allowing the electrodes to be replaced if necessary. The capacitive means comprises either one or two pair of longitudinally spaced apart, annular capacitor plates which circumscribe an electrically conductive member which extends centrally through the body and which interconnects one of the electrodes with the central conductor of the coaxial cable. A sleeve of dielectric material surrounds and electrically insulates the capacitive means from the outer shell of the body portion which electrically connects the other electrode with the outer conductor of the coaxial cable.

According to another object of the invention, an ignitor is provided which includes a pair of annular capacitor plates connected with a ring shaped dielectric member by way of a pair of flexible, electrically conductive ring shaped joints. The electrical connectors are defined by a ring shaped member made of metal such as aluminum to which there is bonded, as by soldering, an electrically conductive wire mesh.

It is a primary object of the present invention to provide a combustion ignitor which is exceptionally low in inductance and resistance and is provided with capacitive means for rapidly transferring a large amount of power to the electrodes of the ignitor.

Another object of the invention is to provide an ignitor as described above which is configured to hold off exceptionally high voltages without internal breakdown.

Another object of the invention is to provide an ignitor as described above in which the electrodes can be removed for repair or replacement.

Still another object of the invention is to provide an ignitor as described above which is exceptionally compact in design so as to require a minimum amount of space in an engine compartment while maximizing the quantity of electrical energy which may be stored therein.

These, and further objects of the invention, will be made clear or will become apparent during the course of the following description of a preferred embodiment of the invention.

BRIEF DESCRIPTION OF THE DRAWINGS

In the drawings, which form an integral part of the specification and are to be read in conjunction therewith, and in which like reference numerals are employed to designate identical components in the various views.

DETAILED DESCRIPTION OF THE PREFERRED EMBODIMENTS

Figure 1:
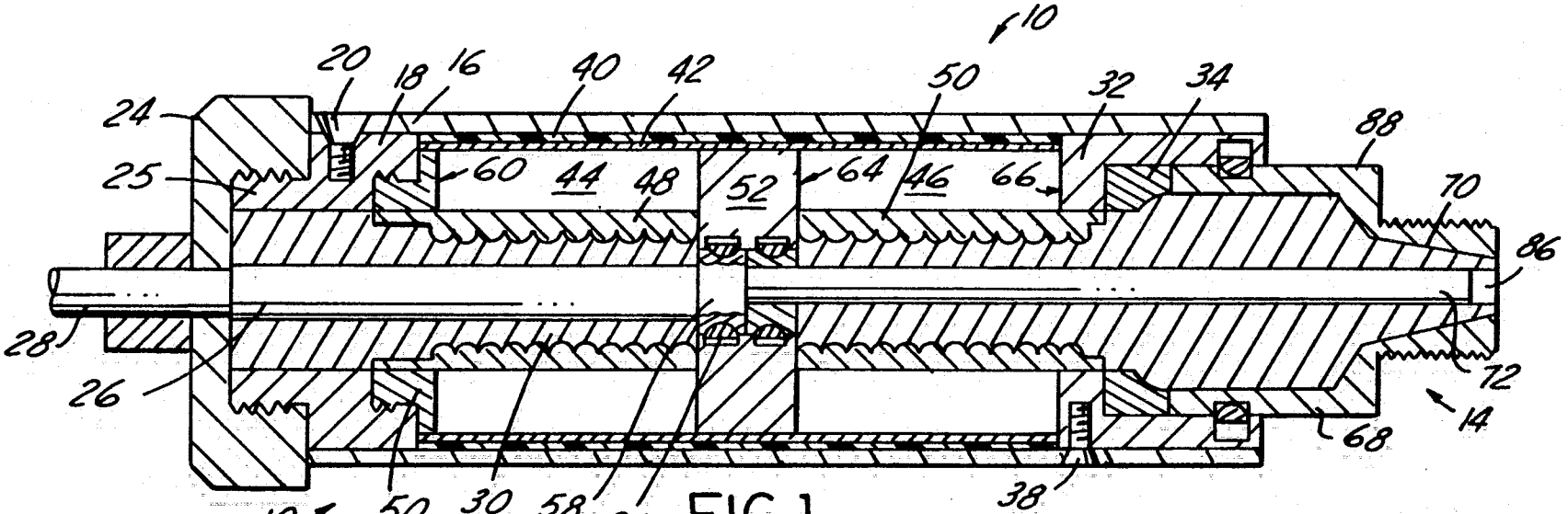
FIG. 1 is a longitudinal view of the combustion ignitor of the present invention, parts being broken away in section for clarity.

Referring to the drawings, the present invention relates to a combustion ignitor generally indicated by the numeral 10 in FIG. 1 which is employed to initiate combustion of fuel. The ignitor 10 may be used, for example, to initiate combustion of a fuel air mixture in an internal combustion engine.

The ignitor 10 includes a body portion 12 adapted to be coupled with a coaxial power supply cable 28, and an electrode portion 14 which, in the illustrated embodiment, comprises a conventional, commercially available spark plug which is removably mounted on the body portion 12. The body portion 12 broadly includes a cylindrical, electrically conductive shell 16, an electrically conductive connector assembly 18 and an electrically conductive end assembly 32. The shell 16 may be formed of stainless steel, for example, and the assemblies 18 and 32 may be formed of brass. The assemblies 18 and 32 are respectively secured in the opposite ends of the shell 16 by any suitable means, such as welding or screws 20, 38, and are also respectively secured as by soldering or the like to form mechanical and electrical connections to capacitor plates 60, 62, 64, 66.

The connector assembly 18 includes a threaded neck portion 25 of reduced diameter which threadably receives a connector cap 24. Connector cap 24 is employed to secure the coaxial power supply cable 28 to the ignitor 10. The connector cap 24 connects the outer conductor of the cable 28 with the neck 25, and connects the inner conductor of cable 28 with a later-discussed electrically conductive connecting member 26 which is centrally disposed within the shell 16 and is held in place by a surrounding filler layer 30 of electrically insulative material, such as molded silicone rubber.

A layer or sleeve 40 of high dielectric strength material such as polyimide covers the inside face of the shell 16 and extends between the opposing faces of the connector and end assemblies 18 and 32 respectively. A second layer or sleeve 42 of compliable dielectric potting compound covers the inside face of the plastic sleeve 40.

A cylindrical connector 52, made of brass or other conductive material, is mounted within the shell 16, approximately midway between the assemblies 18, 32 and is electrically insulated from the shell 16 by means of the sleeves 40, 42. The connector 52 is provided with a central aperture and a pair of snap rings 54 and 56 whose purpose will be discussed later.

The connector assembly 18 threadably receives on its inner face an electrically conductive insert 50. The insert 50 circumscribes the connector rod 26 and includes a ring-shaped, transversely extending conducting layer defining an annular capacitor plate 60. Capacitor plate 60 is longitudinally spaced from and extends parallel a second annular capacitor plate 62. Positioned between the capacitor plates 60, 62 is a ring-shaped, longitudinally extending layer 44 of high dielectric material with a reasonable dielectric constant, such as ceramic, which has a radial width essentially equal to that of plates 60, 62. Plates 60, 62 in combination with the dielectric layer 44 form a capacitor which may be referred to as a discoidal feedthrough capacitor. A second capacitor essentially identical to that just described is formed by capacitor plates 64, 66 and a second layer 46 of high dielectric material.

Two sleeves 48, 50 of compliable dielectric potting compound are respectively provided on the inner face of the above-described capacitors and extend from the connector 52 to and over the edges of assemblies 18 and 32. The inner faces of the sleeves 48, 50 are provided with an undulating surface defined by hills and valleys which function to increase the tracking distance along the surface of an insulator 80 in order to decrease the electric field gradient between plates 60, 62 and 64, 66, and thereby increase the voltage hold-off between such plates. As previously mentioned, a layer 30 of insulating filler material surrounds the connecting member 26 and holds the latter in a central position within the shell 16. The connecting member 26 includes a head 58 provided with a circumferential groove which receives, in snap fit relation, the snap ring 56. Alternatively, the connector 52 and head 58 may be threadably secured together.

The electrode portion 14 of the ignitor 10 broadly includes an outer metal case 68, a central conductor rod 72 and an insulator 80 which electrically insulates the outer case 68 from the conductor rod 72. One end of the conductor rod 72 is provided with an enlarged head 82 having a circumferential groove 84. The snap ring 54 is received in snap fit relationship within the groove 84. The outer case 68 is provided with a circumferential groove 74 within which there is received a second snap ring 36. Snap rings 36 and 54 releasably hold the electrode portion 14 on the body portion 12.

One end 70 of the case 68 is of reduced diameter and is threaded so as to be threadably received within a threaded opening in the cylinder block (not shown) of an internal combustion engine. The outer case 68 is provided with polygonal wrench flats 88 which are adapted to be engaged by a wrench for removing and installing the ignitor 10 in the engine. The outer case 68 is provided with a shoulder 76 which engages a compressible gasket 34 so as to limit the depth of penetration of the electrode portion into the body portion 12 and form a relatively tight seal therebetween.

The insulator 80 may be formed of ceramic or the like and includes a plurality of grooves 78 adjacent one end which are complementally received within the hills and valleys of the sleeve 50 within the body portion 12. The outer face 71 of the reduced diameter end 70 of the outer case 68 defines an annular electrode, the other electrode being defined by the outer end of the rod 72. The outer end of rod 72 defining the second electrode is recessed at 86 to increase the effective gap length between electrodes. The electrode portion 14 may comprise an essentially conventional spark plug, as mentioned above, except that the grooves 78 are formed therein and the outer end of the rod 72 is recessed somewhat, rather than being flush with the outer end of the insulator 80. However, it is not necessary to recess the rod 72 in this manner, as will become later apparent.

Figure 4:
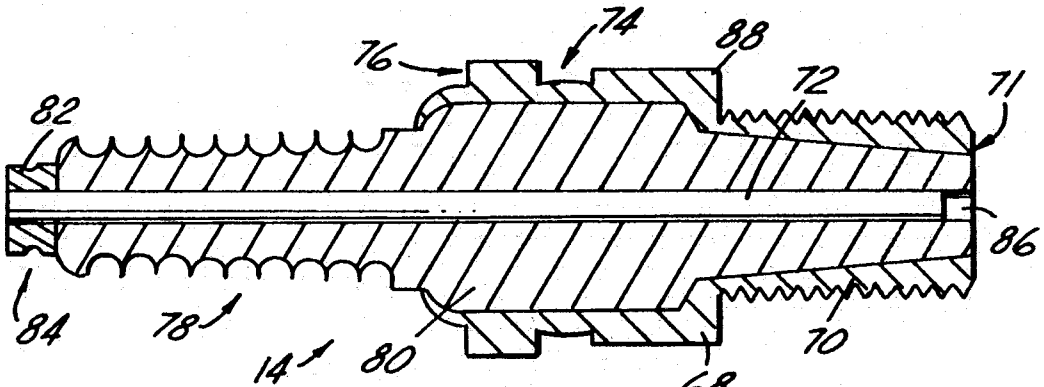
FIG. 4 is a longitudinal view, taken in section, of the electrode portion of the ignitor shown in FIG. 1.
Figure 3:
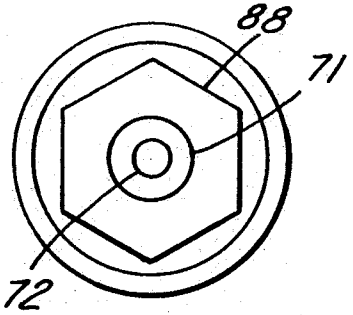
FIG. 3 is a view of the other end of the ignitor shown in FIG. 1.

Referring now particularly to FIGS. 1 and 4, a ground path for current flow between the outer conductor of the coax cable 28 and the outer, annular electrode 71 is defined by the following: cap 24, assembly 18, outer shell 16, end assembly 32, outer case 68. The positive current flow path between the central conductor of the coax cable 28 and the electrode defined on the end of the rod 72 is formed by: the connector member 26, connector 52 and rod 72. It may thus be appreciated that capacitor plate 60 and 66 are negative while plates 62 and 64 are positive. In the preferred form of the invention, capacitor plates 60, 62, 64 and 66 are defined by with a layer of metallization applied to the ends of the dielectric layers 44,46 such as silver frit which is fired onto the layers 44,46 in order to provide intimate physical contact with the dielectric layers 44,46.

The above-described configuration, in which the capacitive elements are annular in shape and circumscribe the central longitudinal electrode, has been found to be particularly effective in achieving high voltage hold-off. As will become apparent hereinafter, although two capacitive elements have been disclosed in the illustrated embodiment, only a single such capacitive element may be employed in those applications where lower energy levels are required.

Figure 5:
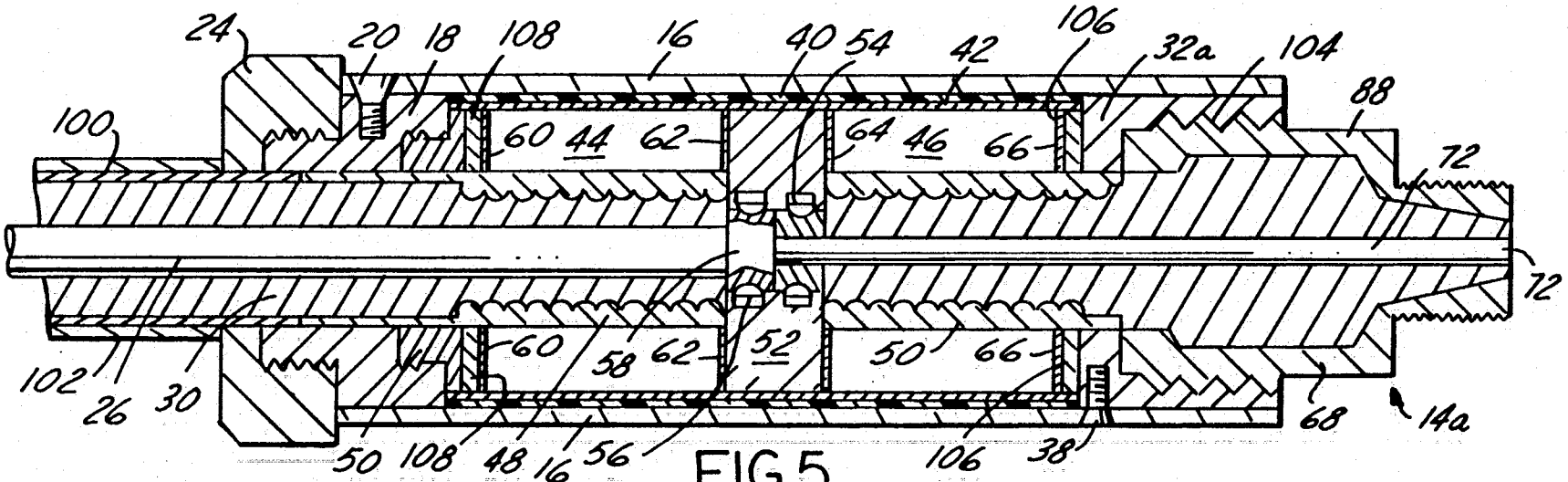
FIG. 5 is a cross sectional view similar to FIG. 1, but showing an alternate embodiment of the present invention.

Attention is now directed to FIG. 5 which depicts an alternate embodiment of the ignitor of the present invention, which is similar in many respects to the ignitor shown in FIG. 1, and accordingly like parts will be designated by the same reference numerals. Further shown in FIG. 5 is the outer conductor 100 which is electrically and mechanically connected to the connector cap 24. The end assembly 32*a* is provided with a threaded inner wall 104 in order to threadably receive the electrodes of 14A which are provided with a threaded outer body 68, as is normally found in a conventional "spark plug". The threads 104 thus function to releasably hold the electrodes 14A within the body portion of 12. A further distinguishing feature of the embodiment of FIG. 5 lies in an electrode rod 72 which extends to a point which is flush with the outer end of the outer case 88; thus, in contrast to the recess 86 of the embodiment of FIG. 1, the two outer electrode surfaces of the embodiment of FIG. 5 are flush with each other, i.e. are coplaner.

Figure 2:
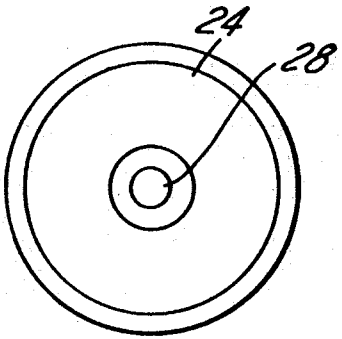
FIG. 2 is a view of one end of the ignitor shown in FIG. 1.
Figure 6:
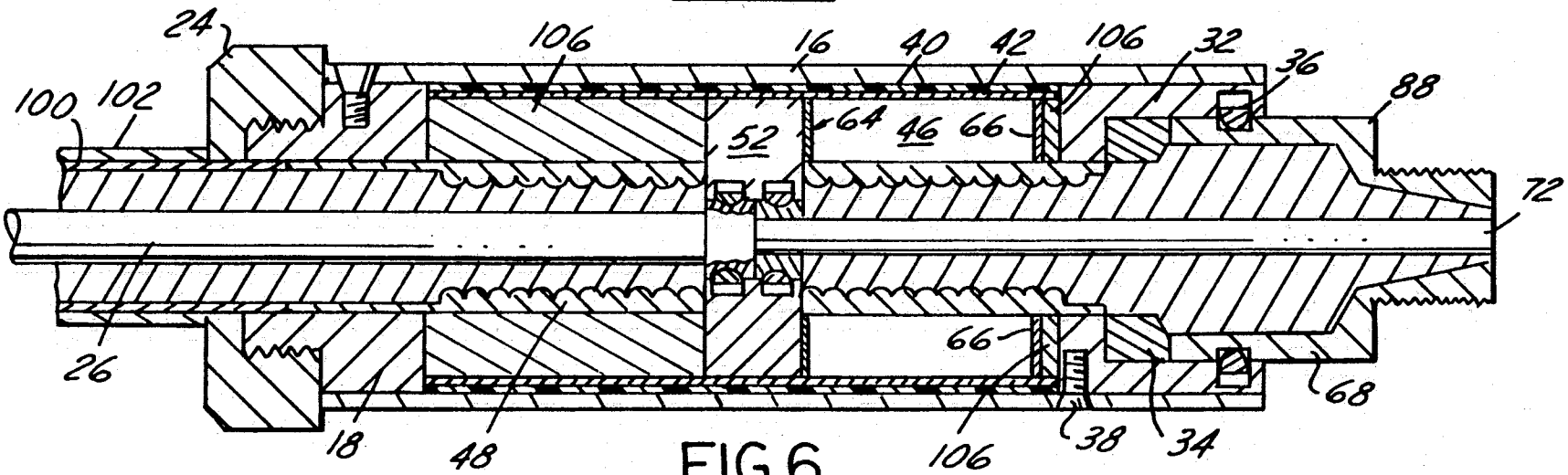
FIG. 6 is a cross sectional view similar to FIG. 1, but showing yet another embodiment of the present invention.

The embodiment of FIG. 5 is further distinguished by the use of a pair of electrically conductive, flexible connectors 106 and 108 respectively. The flexible connectors 106, 108, which will be described in detail later, are each annular in shape and form a flexible, electrical connection between the dielectric member 44 or 46 and the respectively associated insert 50 or end assembly 32*a*. Flexible connectors 106, 108 are respectively secured to the dielectric members 44, 46 and to end connector 32*a* and insert 50 as by soldering so as to respectively form flexible, electrically conductive connections between the capacitor plates 60, 66, and the insert 50 and end assembly 32*a*. By virtue of the construction of flexible connectors 106, 108 some degree of flexure, for example torsional flexure or bending is permitted between the dielectric members 44, 46 and the members 32*a*, 50 without breaking the electrical connections of the capacitors formed thereby, as when, by way of example, the ignitor experiences some degree of flexion as result of torquing it into operative relationship in an engine block or the like or torquing or bending it during the manufacture thereof Referring now to FIG. 6, another alternate embodiment of the present invention is depicted which is generally similar to that shown in FIGS. 1 and 2 but is intended for a lower energy application. Accordingly, rather than employing two capacitive elements as in the embodiments of FIGS. 1 and 5, the embodiment of FIG. 6 employs a single capacitive element defined by the dielectric member 46 and capacitor plates 64 and 66. An insulative insert 106 is provided between the cylindrical connector 52 and the connector assembly 18 to replace the dielectric member 44 of FIG. 5, in order to provide sufficient voltage standoff between the connector 52 and the electrical ground defined by the connector assembly 18 and connector cap 24.

Figure 7:
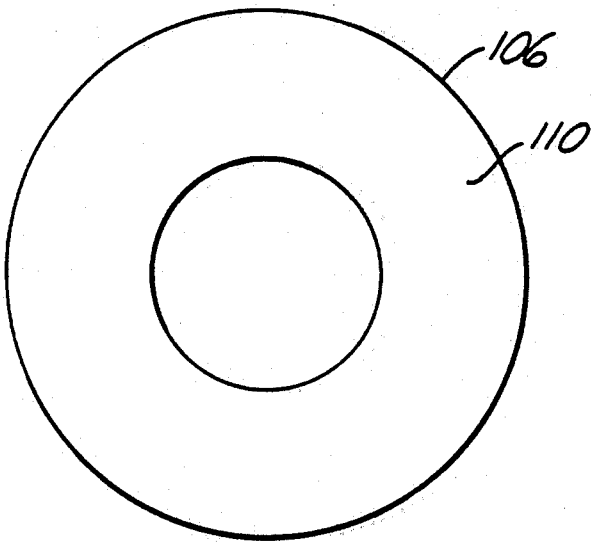
FIG. 7 is an elevational view, taken on an enlarged scale, of one of the flexible connections employed in the embodiments of FIGS. 5 and 6.

FIG. 7 depicts flexible connector 106 in elevation which, incidentally, is identical in construction to flexible connector 108. The flexible connector 106 preferably comprises an inner metal member, as of aluminum, which is substantially solid (but may alternately be hollow) and is covered by an electrically conductive braid or wire mesh 110. The wire mesh 110 completely surrounds the inner metallic member and is in slidable electrical contact therewith. By this arrangement, the faces of the mesh which engage, for example, the capacitor plates 60–66 and the parts 50, 32*a* can remain in stationary contact therewith, while the mesh between these two faces is allowed to bend or twist so as to accommodate relative movement between the plates 60–66 and parts 50, 32*a* while still maintaining electrical contact therebetween.

Figure 8:
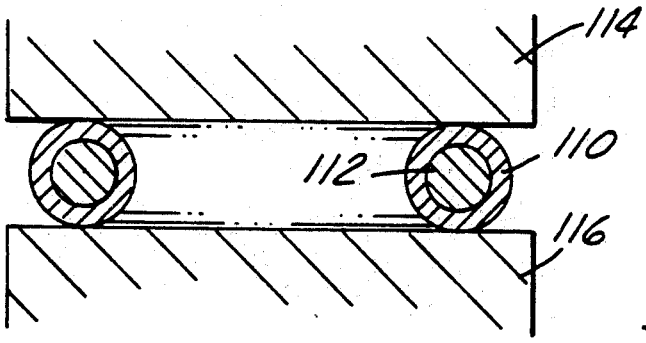
FIG. 8 is a cross sectional view of the connector of FIG. 7 during an intermediate step of the manufacturing thereof.
Figure 9:
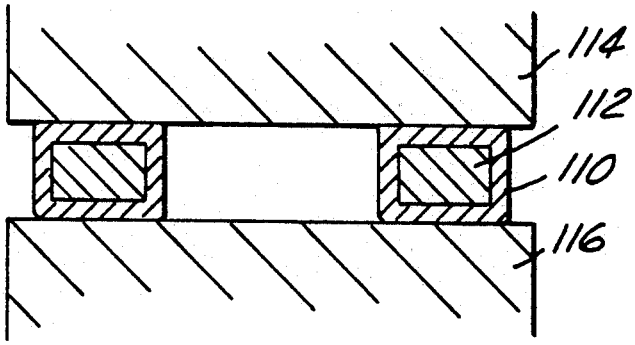
FIG. 9 is a view similar to FIG. 8, but showing the final step in the method of manufacturing the connector of FIG. 7.

A method for making the flexible connector 106 is depicted, in part, in FIGS. 8 and 9. A preferably solid piece of metal rod such as aluminum is formed into an annularly shaped member 112 and is joined at its ends so as to form a closed ring. A layer of conductive metal mesh or braiding 110, preferably a sleeve thereof, is applied over the member 112 and is loosely connected thereto so that the mesh 110 may shift slightly relative to the member 112. Thereafter, the annular member 112 covered by the wire mesh 110 is placed between a pair of press platens 114, 116 and is pressed therebetween until, as shown in FIG. 9, the member 112 and associated wire mesh 110 are compressed or flattened to form two essentially parallel sides or faces which in turn can be sandwiched between one of the dielectric members 44, 46 and the respectively associated connector 32*a*, 50. In FIG. 9 the connector 106 is shown as being compressed into a substantially rectangular shape. It is to be understood that the annular member 112 can either be solid or hollow (ring shaped in cross section) and that it is only necessary that the connector 106 be formed into a shape which presents two opposite sides so as to make good electrical contact with both the insulating members 44, 46 and the end connectors 32*a*, 50. In some applications the member 112 may need not be flattened.

Having thus described the invention, it is recognized that those skilled in the art may make various modifications or additions to the preferred embodiment chosen to illustrate the invention without departing from the spirit and scope of the present contribution to the art. Accordingly, it is to be understood that the protection sought and to be afforded hereby should be deemed to extend to the subject matter claimed and all equivalents thereof fairly within the scope of the invention.

What is claimed is:

1. An ignitor device for connection with a coaxial, electrical supply cable including an inner cable conductor and an outer cable conductor, said device comprising:

an outer, generally cylindrical conductive shell defining a first conductive path allowing the flow of electrical current in one direction longitudinally therethrough;

means for electrically interconnecting said outer cable conductor with said outer shell;

an inner conductor coupled with said inner conductor cable and concentrically disposed within said outer shell, said inner conductor defining a second conductive path allowing the flow of electrical current in a direction opposite said one direction;

the concentric disposition of said outer shell and said inner conductor and the flow of electrical current in opposite directions respectively through said outer shell and said inner conductor resulting in a low inductance configuration;

a pair of electrodes respectively connected with said outer shell and said inner conductor and defining a gap across which electrical energy may be discharged; and at least a first annular capacitor concentric with and disposed between said outer shell and said inner conductor.

2. The ignitor device of claim 1, including an annular layer of high dielectric strength material between said capacitor and said outer shell.

3. The ignitor device of claim 1, wherein said capacitor includes a pair of essentially parallel, longitudinally spaced annular capacitor plates.

4. The ignitor device of claim 1, including a second annular capacitor longitudinally spaced from said first capacitor, said second capacitor being concentric with and disposed between said outer shell and said inner conductor.

5. The ignitor device of claim 1, including means adapted to connect said outer shell and said inner conductor with a coaxial power supply cable.

6. The ignitor device of claim 1, wherein said pair of electrodes are defined by a module removably mounted on said outer shell to allow replacement of said electrodes.

7. The ignitor device of claim 6, wherein said module includes:

a central elongate conductor connected with one of said electrodes, an outer conductor surrounding said central conductor and connected with said outer shell, and a layer of electrically insulative material between said central conductor and said outer conductor.

8. The ignitor device of claim 7, wherein:

said central conductor extends beyond said insulative material on one end thereof opposite said electrodes, and said device further includes means for releasably holding said one end of said central conductor.

9. The ignitor device of claim 7, including means on said outer shell for releasably holding said outer conductor on said outer shell.

10. The ignitor device of claim 4, including an annular conductor for electrically interconnecting said first and second capacitors with said inner conductor.

11. A combustion initiation device for connection with a coaxial electrical supply cable including an inner cable conductor and an outer conductor cable, said device comprising:

a body portion including means adapted for coupling said device with said inner and outer cable conductors;

capacitive means on said body for storing electrical energy supplied from said source;

an ignitor portion including a pair of electrodes between which electrical energy stored in said capacitive means can be discharged; and means for releasably mounting said ignitor portion on said body portion to allow replacement of said electrodes.

12. The device of claim 11, wherein said ignitor portion includes;

an outer conductive shell, a central, elongate conductor within and coaxial with said shell, and means for electrically insulating said shell from said central conductor.

13. The device of claim 12, wherein:

said outer shell includes an annular shoulder engaging said body portion, and said mounting means includes means on said body portion for clamping said outer shell.

14. The device of claim 12, wherein said capacitive means is annular in shape and surrounds said central conductor.

15. The device of claim 11, wherein:

said body portion is essentially cylindrical, and said capacitive means is annular in shape, said capacitive means being disposed between said body portion and said ignitor.

16. The device of claim 11, wherein:

said ignitor includes an outer conductor and an inner conductor respectively connected with said electrodes, and said mounting means includes means for clamping said inner and outer conductors on said body portion.

17. A device for initiating combustion of fuel and connectable with a coaxial electrical supply cable including an inner cable conductor and an outer cable conductor, said device comprising:

a generally cylindrical elongate body including a pair of conductors and means for electrically interconnecting said pair of conductors respectively with said inner and outer cable conductors;

capacitive means on said body for storing electrical energy, said capacitive means including a pair of longitudinally spaced, annular capacitor plates respectively connected with said conductors; and a pair of electrodes mounted on said body and respectively connected with said conductors for producing an electrical discharge using electrical energy stored in said capacitive means.

18. The device of claim 17, wherein said capacitive means includes an annular body of high dielectric material between said plates.

19. The device of claim 17, wherein:

said body includes an outer electrically conductive shell defining one of said conductors, the other of said conductors being coaxially disposed centrally within said outer shell, said capacitive means being disposed between said outer shell and the central conductor.

20. The device of claim 19, including a layer of high dielectric material between said outer shell and said capacitive means.

21. The device of claim 17, wherein said capacitor plates are disposed between and extend transverse to said conductors.

22. A device for igniting combustion of fuel, and connectable with a coaxial, electrical supply cable having an inner cable conductor and an outer conductor cable, said device comprising:

a generally cylindrical, electrically conductive shell defining a conductive path through which current flows in one longitudinal direction through said device;

means for electrically interconnecting said shell with said outer cable conductor;

a central conductor coaxially disposed within said shell and through which current flows in the opposite longitudinal direction through said device;

means for electrically interconnecting said central conductor with said inner cable conductor;

a pair of discharge electrodes on one end of said device and respectively electrically connected with said shell and said inner conductor; and capacitive means for storing electrical energy in said device, said capacitive means including a pair of annular capacitor plates surrounding said central conductor and spaced apart from each other along the longitudinal axis of said central conductor, the surfaces of said plates extending generally parallel to each other and normal to said longitudinal axis.

23. An ignitor device for use with a coaxial electrical supply cable having an inner cable conductor and an outer cable conductor, said device comprising:

an outer, generally cylindrical conductive shell defining a first conductive path allowing the flow of electrical current in one direction longitudinally therethrough;

means for electrically interconnecting said outer cable conductor with said shell;

an inner conductor concentrically disposed within said outer shell and defining a second conductive path allowing the flow of electrical current in a direction opposite said one direction, the concentric disposition of said outer shell and said inner conductor and the flow of electrical current in opposite directions respectively through said outer shell and said inner conductor resulting in a low inductance configuration;

means for electrically interconnecting said inner cable conductor with said inner conductor;

a pair of electrodes respectively connected with said outer shell and said inner conductor and defining a gap across which electrical energy may be discharged; and a pair of essentially parallel, longitudinally spaced annular capacitor plates which are both concentric with and disposed between said outer shell and said inner conductor.

24. An ignitor device for use with a coaxial electrical supply cable having an inner cable conductor and an outer cable conductor, said device comprising:

an outer, generally cylindrical conductive shell defining a first conductive path allowing the flow of electrical current in one direction longitudinally therethrough;

means for electrically interconnecting said outer cable conductor with said shell;

an inner conductor concentrically disposed within said outer shell and defining a second conductive path allowing the flow of electrical current in a direction opposite said one direction, the concentric disposition of said outer shell and said inner conductor and the flow of electrical current in opposite directions respectively through said outer shell and said inner conductor resulting in a low inductance configuration;

means for electrically interconnecting said inner cable conductor with said inner conductor;

a pair of electrodes respectively connected with said outer shell and said inner conductor and defining a gap across which electrical energy may be discharged;

a first annular capacitor concentric with and disposed between said outer shell and said inner conductor; and a second annular capacitor longitudinally spared from said first capacitor, said second capacitor being concentric with and disposed between said outer shell and said inner conductor.

25. An ignitor device for use with a coaxial electrical supply cable having an inner cable conductor and an outer cable conductor, said device comprising:

an outer, generally cylindrical conductive shell defining a first conductive path allowing the flow of electrical current in one direction longitudinally therethrough;

means for electrically interconnecting said outer cable conductor with said shell;

an inner conductor concentrically disposed within said outer shell and defining a second conductive path allowing the flow of electrical current in a direction opposite said one direction, the concentric disposition of said outer shell and said inner conductor and the flow of electrical current in opposite directions respectively through said outer shell and said inner conductor resulting in a low inductance configuration;

means for electrically interconnecting said inner cable conductor with said inner conductor;

a pair of electrodes respectively connected with said outer shell and said inner conductor and defining a gap across which electrical energy may be discharged, wherein said pair of electrodes are defined by a module removably mounted on said outer shell to allow replacement of said electrodes; and at least a first annular capacitor concentric with and disposed between said outer shell and said inner conductor.

26. The ignitor device of claim 25, wherein said module includes:

a central elongate conductor connected with one of said electrodes, an outer conductor surrounding said central conductor and connected with said outer shell, and a layer of electrically insulative material between said central conductor and said outer conductor.

27. The ignitor device of claim 26, wherein:

said central conductor extends beyond said insulative material on one end thereof opposite said electrodes, and said device further includes means for releasably holding said one end of said central conductor.

28. The ignitor device of claim 26, including means on said outer shell for releasably holding said outer conductor on said outer shell.

29. The ignitor device of claim 24, including an annular conductor for electrically interconnecting said first and second capacitors with said inner conductor.

30. An ignitor for receiving and transferring electrical energy, from an energy source via a coaxial electrical supply cable including an inner cable conductor and an outer cable conductor, to a pair of electrodes, said ignitor comprising:

a conductor body having an electrically conductive outer conductor and an electrically conductive inner conductor which is disposed within said outer conductor and is adapted to receive said electrical energy from said energy source;

means for electrically connecting said outer cable conductor with said outer conductor of said conductor body, means for electrically interconnecting said inner cable conductor with said inner conductor of said conductor body;

capacitor means concentrically and conductively coupled to said inner conductor and electrically insulated from said outer conductor for temporarily storing said electrical energy received by said inner conductor and for transferring said temporarily stored energy to said pair of electrodes.

31. The ignitor of claim 30 comprising:

insertion means, coupled to said energy source, for allowing said energy source to be removably coupled to said inner conductor.

32. The ignitor of claim 30 further comprising:

electrode means, coupled to said capacitor means, for allowing said pair of electrodes to be removably coupled to said capacitor means.

33. The ignitor of claim 30 wherein said capacitor means comprises:

a first annular electrically conductive ring removably coupled to said inner conductor;

a second annular electrically conductive ring coupled to said inner conductor and in voltage communication with said first annular ring; and dielectric means coupled to both said first and said second annular rings and cooperating with said first and said second rings for allowing said electrical energy, received by said inner conductor, to be temporarily stored and later transferred to said pair of electrodes.

34. An ignitor device, comprising:

an outer, generally cylindrical conductive shell defining a first conductive path allowing the flow of electrical current in one direction longitudinally therethrough;

an inner conductor concentrically disposed within said outer shell and defining a second conductive path allowing the flow of electrical current in a direction opposite said one direction;

the concentric disposition of said outer shell and said inner conductor and the flow of electrical current in opposite directions respectively through said outer shell and said inner conductor resulting in a low inductance configuration;

a pair of electrodes respectively connected with said outer shell and said inner conductor and defining a gap across which electrical energy be discharged; and, an annular capacitor concentric with and disposed between said outer shell and said inner conductor, said capacitor including a pair of essentially parallel, longitudinally spaced annular capacitor plates.

35. An ignitor device, comprising:

an outer, generally cylindrical conductive shell defining a first conductive path allowing the flow of electrical current in one direction longitudinally therethrough;

an inner conductor concentrically disposed within said outer shell and defining a second conductive path allowing the flow of electrical current in a direction opposite said one direction;

the concentric disposition of said outer shell and said inner conductor and the flow of electrical current in opposite directions respectively through said outer shell and said inner conductor resulting in a low inductance configuration;

a pair of electrodes respectively connected with said outer shell and said inner conductor and defining a gap across which electrical energy be discharged;

at least a first annular capacitor concentric with and disposed between said outer shell and said inner conductor; and a second annular capacitor longitudinally spaced from said first capacitor, said second capacitor being concentric with and disposed between said outer shell and said inner conductor.

36. The ignitor device of claim 35, including an annular conductor for electrically interconnecting said first and second capacitors with said inner conductor.

37. An ignitor device for connection with a coaxial, electrical supply cable including an inner cable conductor and an outer cable conductor, said device, comprising:

an outer, generally cylindrical conductive shell defining a first conductive path allowing the flow of electrical current in one direction longitudinally therethrough;

means for electrically interconnecting said outer cable conductor with said outer shell;

an inner conductor coupled with said inner conductor cable and concentrically disposed within said outer shell, said inner conductor defining a second conductive path allowing the flow of electrical current in a direction opposite said one direction;

the concentric disposition of said outer shell and said inner conductor and the flow of electrical current in opposite directions respectively through said outer shell and said inner conductor resulting in a low inductance configuration;

a pair of electrodes respectively connected with said outer shell and said inner conductor and defining a gap across which electrical energy may be discharged; and, at least a first annular capacitor concentric with and disposed between said outer shell and said inner conductor, said pair of electrodes being defined by a module removably mounted on said outer shell to allow replacement of said electrodes, said module including (a) a central, elongate conductor connected with one end of said electrodes, (b) an outer conductor surrounding said central conductor and connected with said outer shell, and (c) a layer of electrically insulative material between said central conductor and said outer conductor.

38. The ignitor device of claim 37, wherein:

said central conductor extends beyond said insulative material on one end thereof opposite said electrodes, and said device further includes means for releasably holding one end of said central conductor.

39. The ignitor device of claim 37, including means on said outer shell for releasably holding said outer conductor on said outer shell.

40. An ignitor for receiving and transferring electrical energy, from an energy source, to a pair of electrodes, said ignitor comprising:

a conductor having an electrically conductive outer conductor and an electrically conductive inner conductor which is disposed within said outer conductor and is adapted to receive said electrical energy from said energy source; and, capacitor means concentrically and conductively coupled to said inner conductor and electrically insulated from said outer conductor for temporarily storing said electrical energy received by said inner conductor and for transferring said temporarily stored energy to said pair of electrodes, said capacitor means including (a) a first annular electrically conductive ring removably coupled to said inner conductor, (b) a second annular electrically conductive ring coupled to said inner conductor and in voltage communication with said first annular ring, and (c) dielectric means coupled to both said first and said second annular rings and cooperating with said first and second rings for allowing said electrically energy, received by said inner conductor, to be temporarily stored and later transferred to said pair of electrodes.

* * * * *